US007745086B2

(12) United States Patent
Koido

(10) Patent No.: US 7,745,086 B2
(45) Date of Patent: Jun. 29, 2010

(54) DEVELOPER MATERIAL, DEVELOPER MATERIAL CARTRIDGE, IMAGE FORMING DEVICE, AND IMAGE FORMING APPARATUS

(75) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 307 days.

(21) Appl. No.: 11/905,157

(22) Filed: Sep. 27, 2007

(65) Prior Publication Data

US 2008/0131803 A1 Jun. 5, 2008

(30) Foreign Application Priority Data

Sep. 28, 2006 (JP) ..... 2006-263734

(51) Int. Cl.
*G03G 9/087* (2006.01)

(52) U.S. Cl. ..... 430/110.1; 399/252

(58) Field of Classification Search ..... 430/110.1; 399/252

See application file for complete search history.

(56) References Cited

U.S. PATENT DOCUMENTS 6,783,910 B2 * 8/2004 Kohtaki et al. ..... 430/109.3
2003/0180644 A1 * 9/2003 Nanya et al. ..... 430/108.22
2007/0003857 A1 * 1/2007 Eida et al. ..... 430/110.4

FOREIGN PATENT DOCUMENTS

| | | |
|---|---|---|
| JP | 2001-75309 | 3/2001 |
| JP | 2003-167375 | 6/2003 |
| JP | 2004-13049 | 1/2004 |
| JP | 2004-54236 | 2/2004 |
| JP | 2004-295101 | 10/2004 |
| JP | 2006-221122 | 8/2006 |

* cited by examiner

*Primary Examiner*—John L Goodrow
(74) *Attorney, Agent, or Firm*—Rabin & Berdo, PC

(57) ABSTRACT

A developer material includes base particles that contain at least a binder resin and a colorant, and an external additive that covers the surface of the base particles. The developer material has a mean volume particle diameter in the range of 3.9-6.1 μm, and includes pulverized base particles of an external additive. The external additive has a mean particle diameter in the range of 30-110 nm, the external additive being in an amount in the range of 1.0-3.0 weight parts based on 100 weight parts of the base particles. The external additive covers a surface of the base particles, a surface area of the base particles being covered with said external additive, the surface area being in the range of 30.6-58.6% of a total surface area of the base particles.

20 Claims, 13 Drawing Sheets

FIG.12

| | TONER | PARTICLE DIAMETER | SILICA | PARTICLE DIAMETER OF SILICA | EXTERNAL ADDITIVE (WEIGHT PARTS) | FIRST PAGES IN CONTINUOUS PRINTING | AFTER CONTINUOUS PRINTING | |
|---|---|---|---|---|---|---|---|---|
| | | | | | | FOG OF CALENDERED PAPER ΔE | FOG OF CALENDERED PAPER ΔE | FILMING ON DEVELOPING ROLLER (VISUAL INSPECTION) |
| EXAMPLE 1 | TONER 1 | 6.1 | NAX-50 | 30 | 1.0 | 1.2 | 1.5 | NO |
| EXAMPLE 2 | TONER 2 | 6.1 | NAX-50 | 30 | 3.0 | 1.1 | 1.2 | NO |
| EXAMPLE 3 | TONER 3 | 6.1 | X-24-9163A | 110 | 1.0 | 1.2 | 1.4 | NO |
| EXAMPLE 4 | TONER 4 | 6.1 | X-24-9163A | 110 | 3.0 | 1.0 | 1.1 | NO |
| EXAMPLE 5 | TONER 5 | 3.9 | NAX-50 | 30 | 1.0 | 0.8 | 0.9 | NO |
| EXAMPLE 6 | TONER 6 | 3.9 | NAX-50 | 30 | 3.0 | 0.7 | 0.9 | NO |
| EXAMPLE 7 | TONER 7 | 3.9 | X-24-9163A | 110 | 1.0 | 1.0 | 1.2 | NO |
| EXAMPLE 8 | TONER 8 | 3.9 | X-24-9163A | 110 | 3.0 | 0.9 | 1.1 | NO |
| COMPARATIVE EXAMPLE 1 | TONER 9 | 8.0 | NAX-50 | 30 | 1.0 | 1.6(POOR) | 1.8(POOR) | NO |
| COMPARATIVE EXAMPLE 2 | TONER 10 | 3.0 | X-24-9163A | 110 | 3.0 | 0.8 | - | YES (25000 PAGES) |
| COMPARATIVE EXAMPLE 3 | TONER 11 | 3.9 | RX200 | 12 | 3.0 | 1.4 | 2.1(POOR) | NO |
| COMPARATIVE EXAMPLE 4 | TONER 12 | 6.1 | TSX-55 | 300 | 3.0 | 1.2 | - | YES (15000 PAGES) |
| COMPARATIVE EXAMPLE 5 | TONER 13 | 3.9 | NAX-50 | 30 | 0.5 | 0.9 | - | YES (20000 PAGES) |
| COMPARATIVE EXAMPLE 6 | TONER 14 | 6.1 | X-24-9163A | 110 | 5.0 | 0.8 | 2.0(POOR) | NO |

- IF VALUE OF FOG OF CALENDERED PARER $\Delta E \leqq 1.5$, TEST RESULT IS GOOD.
- IF NO FUSED AND ADHERED TONER IS OBSERVED ON DEVELOPING ROLLER, TEST RESULT IS GOOD.
- 2.0 WEIGHT PARTS SILICA R972 IS ADDED TO TONERS 1 TO 14.

FIG.13

| | TONER | PERCENTAGE OF COATING (%) | FILMING ON DEVELOPPING BLADE |
|---|---|---|---|
| EXAMPLE 1 | TONER 1 | 30.6 | NO |
| EXAMPLE 2 | TONER 2 | 91.7 | YES |
| EXAMPLE 3 | TONER 3 | 8.3 | YES |
| EXAMPLE 4 | TONER 4 | 25.0 | YES |
| EXAMPLE 5 | TONER 5 | 19.5 | YES |
| EXAMPLE 6 | TONER 6 | 58.6 | NO |
| EXAMPLE 7 | TONER 7 | 5.3 | YES |
| EXAMPLE 8 | TONER 8 | 16.0 | YES |
| COMPARATIVE EXAMPLE 1 | TONER 9 | 40.1 | NO |
| COMPARATIVE EXAMPLE 2 | TONER 10 | 12.3 | YES |
| COMPARATIVE EXAMPLE 3 | TONER 11 | 146.6 | YES |
| COMPARATIVE EXAMPLE 4 | TONER 12 | 9.2 | YES |
| COMPARATIVE EXAMPLE 5 | TONER 13 | 9.8 | YES |
| COMPARATIVE EXAMPLE 6 | TONER 14 | 41.7 | NO |

• PERCENTAGE OF COATING IS CALCULATED USING $P=2.2g/cm^3$ AND $P=1.2g/cm^3$.

FIG.14

| NUMBER OF PRINTED PAGES | THE NUMBER OF ROTATIONS | |
|---|---|---|
| | PHOTOCONDUCTIVE DRUM | DEVELOPING ROLLER |
| 15000 | 56824.0 | 71598.3 |
| 20000 | 75763.5 | 95462.0 |
| 25000 | 94703.0 | 119325.7 |
| 30000 | 113642.4 | 1430189.4 |
| 40000 | 151521.3 | 190916.9 |

DIAMETER OF PHOTOCONDUCTIVE DRUM IS 30min
DIAMETER OF DEVELOPING ROLLER IS 15.95mm

FIG.15

| NUMBER OF PRINTED PAGES | THE NUMBER OF ROTATIONS | |
|---|---|---|
| | PHOTOCONDUCTIVE DRUM | DEVELOPING ROLLER |
| 5000 | 47348.6 | 59659.3 |
| 10000 | 94697.3 | 119318.6 |
| 20000 | 189394.5 | 238637.1 |

FIG.17

| | TONER | PARTICLE DIAMETER | SILICA | DIAMETER OF SILICA | EXTERNAL ADDITIVE (WEIGHT PARTS) | LINE PRESSURE [gf/mm] | FILMING ON PHOTOCONDUCTIVE DRUM |
|---|---|---|---|---|---|---|---|
| EXAMPLE 9 | TONER 5 | 3.9 | NAX-50 | 30 | 1.0 | 1.4 | GOOD |
| EXAMPLE 10 | TONER 1 | 6.1 | NAX-50 | 30 | 1.0 | 1.4 | EXCELLENT |
| EXAMPLE 11 | TONER 7 | 3.9 | X-24-9163A | 110 | 1.0 | 1.4 | EXCELLENT |
| EXAMPLE 12 | TONER 6 | 3.9 | NAX-50 | 30 | 3.0 | 1.4 | EXCELLENT |
| EXAMPLE 13 | TONER 5 | 3.9 | NAX-50 | 30 | 1.0 | 0.8 | GOOD |
| EXAMPLE 14 | TONER 5 | 3.9 | NAX-50 | 30 | 1.0 | 1.6 | EXCELLENT |
| EXAMPLE 15 | TONER 5 | 3.9 | NAX-50 | 30 | 1.0 | 2.4 | EXCELLENT |
| COMPARATIVE EXAMPLE 7 | TONER 5 | 3.9 | NAX-50 | 30 | 1.0 | 0.4 | * |
| COMPARATIVE EXAMPLE 8 | TONER 5 | 3.9 | NAX-50 | 30 | 1.0 | 3.0 | POOR |

* : CONTINUOUS PRINTING WAS DISCONTINED DUETO POOR CLEANING

DEVELOPER MATERIAL, DEVELOPER MATERIAL CARTRIDGE, IMAGE FORMING DEVICE, AND IMAGE FORMING APPARATUS

BACKGROUND OF THE INVENTION

1. Field of the Invention

The present invention relates to a developer material, a developer cartridge, image forming device, and an image forming apparatus.

2. Description of the Related Art

A conventional electrophotographic printer uses a toner that contains at least a resin, a colorant, and a toner release agent. For improving image quality, the ratio of the amount of the toner release agent to that of the colorant is selected to be in the range of 0.3 to 10.

Recently, office automation places strong demands on printer outputs with high resolution at high speed. The toner release agent in the toner may cause filming in high resolution and high speed printing.

SUMMARY OF THE INVENTION

An object of the invention is to solve the aforementioned drawbacks of the conventional art.

A developer material includes base particles that contain at least a binder resin and a colorant, and an external additive that covers the surface of the base particles. The developer material has a mean volume particle diameter in the range of 3.9-6.1 μm, and includes pulverized base particles of an external additive. The external additive has a mean particle diameter in the range of 30-110 nm, the external additive being in an amount in the range of 1.0-3.0 weight parts based on 100 weight parts of the base particles.

A developer material cartridge holds a developer material therein, the developer material including base particles and an external additive added to a surface of the base particles. The developer material includes pulverized base particles and particles of an external additive having a mean particle diameter in the range of 30-110 nm. The developer material has a mean volume particle diameter in the range of 3.9-6.1 μm. The external additive is in an amount in the range of 1.0-3.0 weight parts based on 100 weight parts of the base particles.

An image forming device includes a developer material (e.g., toner), a latent image bearing body (e.g., photoconductive drum), a charging member, a developer material bearing body (e.g., developing roller), and a resilient member (e.g., cleaning blade). The developer material includes base particles and an external additive that covers the surface of the base particles, the base particles containing at least a binder resin and a colorant therein. The latent image bearing body bears an electrostatic latent image thereon. The charging member charges the surface of the latent image bearing body. The developer material bearing body supplies the developer to a latent image formed on the latent image bearing body to form a visible image. The resilient member is in contact with the latent image bearing body and is disposed upstream of the charging member and downstream of the developer material bearing body. The developer material includes pulverized base particles and particles of an external additive having a mean particle diameter in the range of 30-110 nm. The developer material has a mean volume particle diameter in the range of 3.9-6.1 μm. The external additive is in an amount in the range of 1.0-3.0 weight parts based on 100 weight parts of the base particles.

An image forming apparatus, includes a developer material, a charging member, a developer material bearing body, and a resilient member. The developer material includes base particles and an external additive that covers the surface of the base particles, the base particles containing at least a binder resin and a colorant therein. The latent image bearing body bears an electrostatic latent image thereon. The charging member charges a surface of the latent image bearing body. The developer material bearing body supplies the developer to a latent image formed on the latent image bearing body to develop the latent image into a visible image. The resilient member is in contact with the latent image bearing body. The resilient member is disposed upstream of the charging member and downstream of the developer material bearing body, and transfers the visible image on a print medium. The developer material includes pulverized base particles, and particles of an external additive having a mean particle diameter in the range of 30-110 nm. The developer has a mean volume particle diameter in the range of 3.9-6.1 μm. The external additive is in an amount in the range of 1.0-3.0 weight parts based on 100 weight parts of the base particles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 12 is a first table that lists types of toners tested and the test results;

FIG. 13 is a second table that lists another test results;

FIG. 14 is a table that lists the number of rotations of a photoconductive drum and a developing roller;

FIG. 15 is a table that lists the number of printed pages, the number of rotations of the photoconductive drum, and the number of rotations of the developing roller;

FIG. 17 is a table that lists the results of experiments.

DETAILED DESCRIPTION OF THE INVENTION

Printing was performed on A4 size paper throughout the embodiments.

First Embodiment

Figure 1:
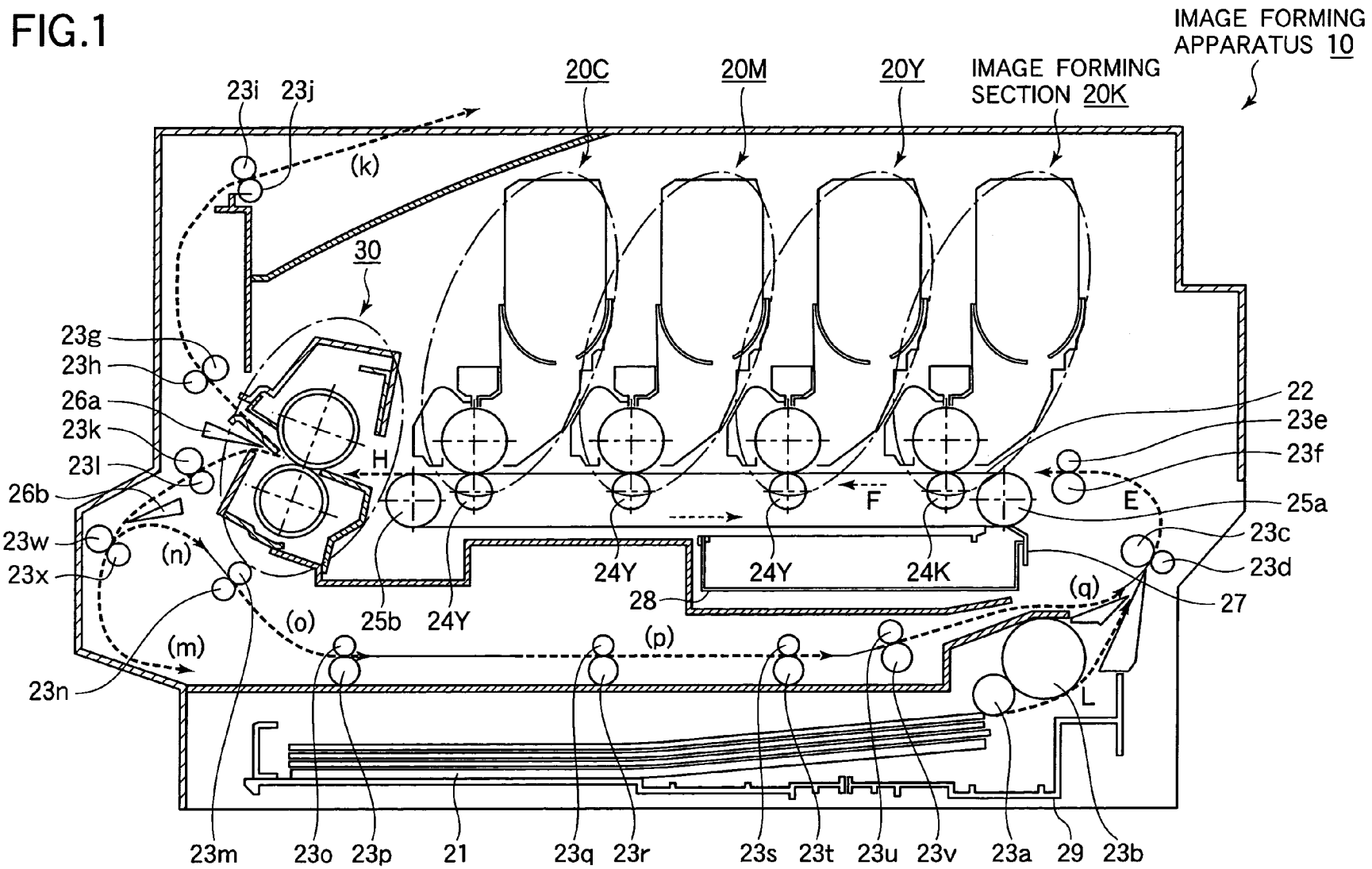
FIG. 1 illustrates a general configuration of an image forming apparatus of a first embodiment.

FIG. 1 illustrates a general configuration of an image forming apparatus of a first embodiment.

Figure 2:
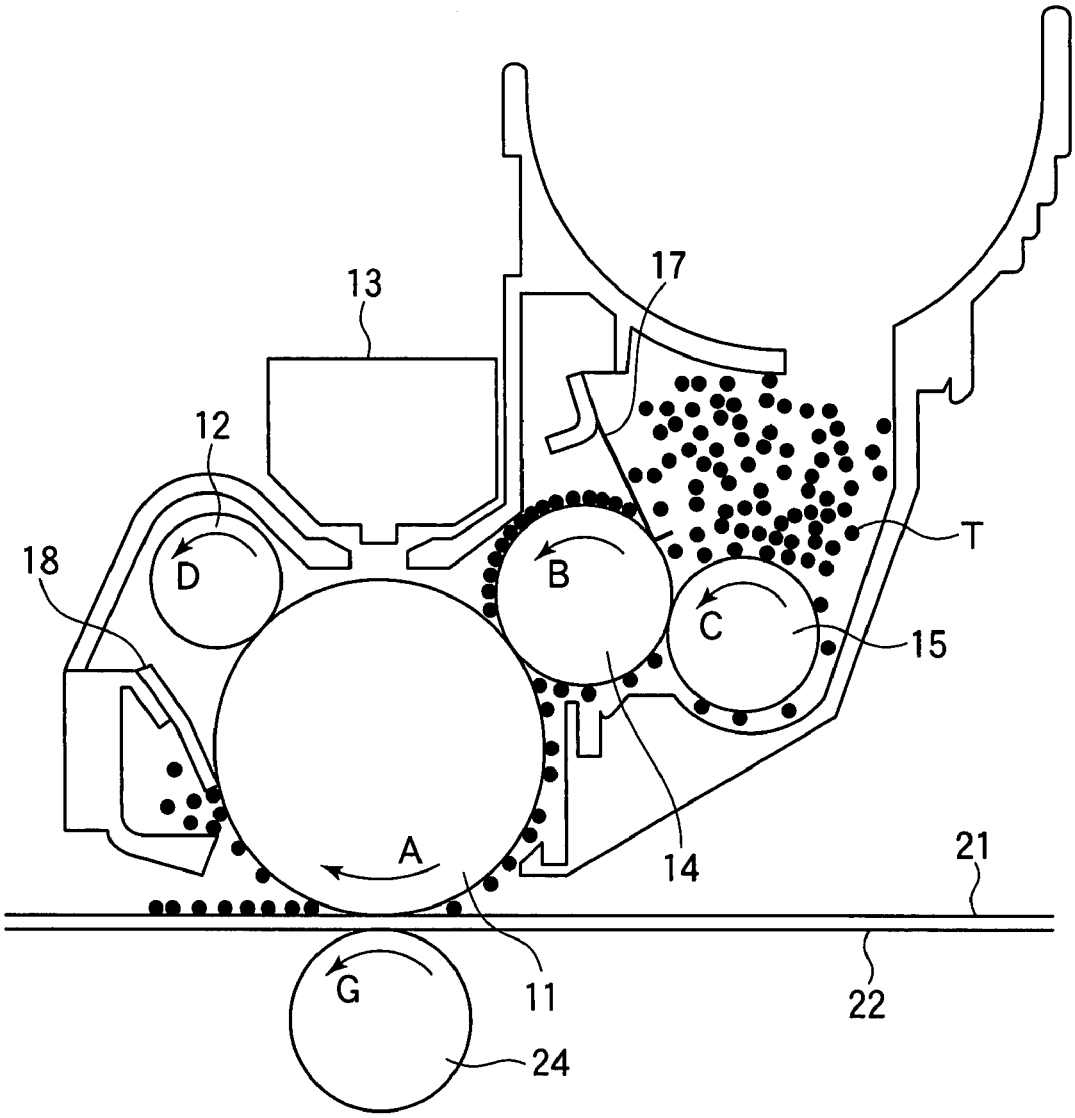
FIG. 2 is an expanded view of an image forming section from which a developer cartridge has been detached.
Figure 3:
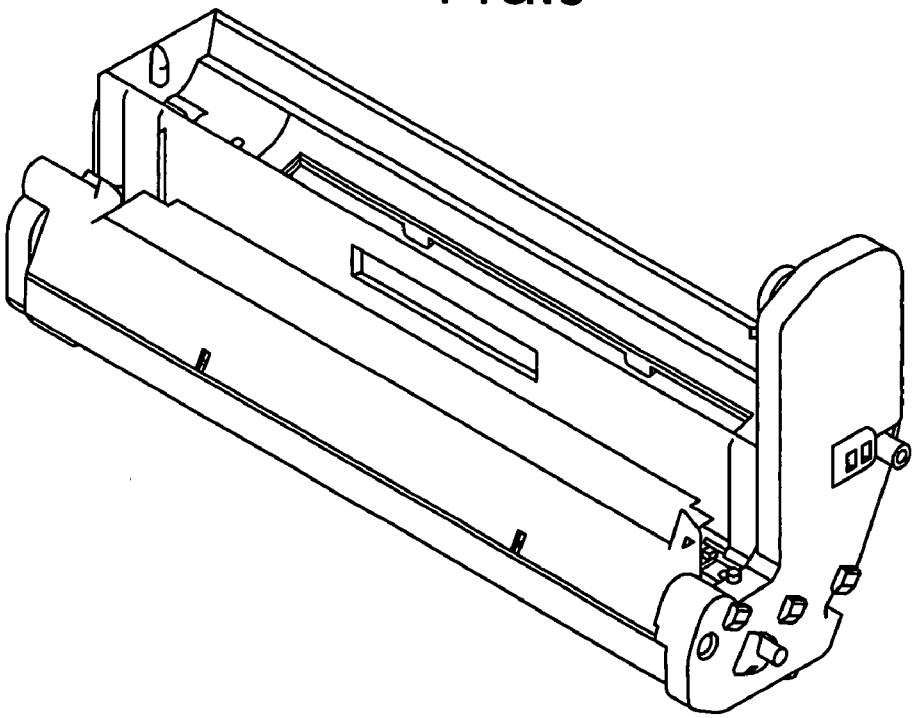
FIG. 3 is a perspective view of the image forming section when the developer cartridge has been detached.
Figure 4:
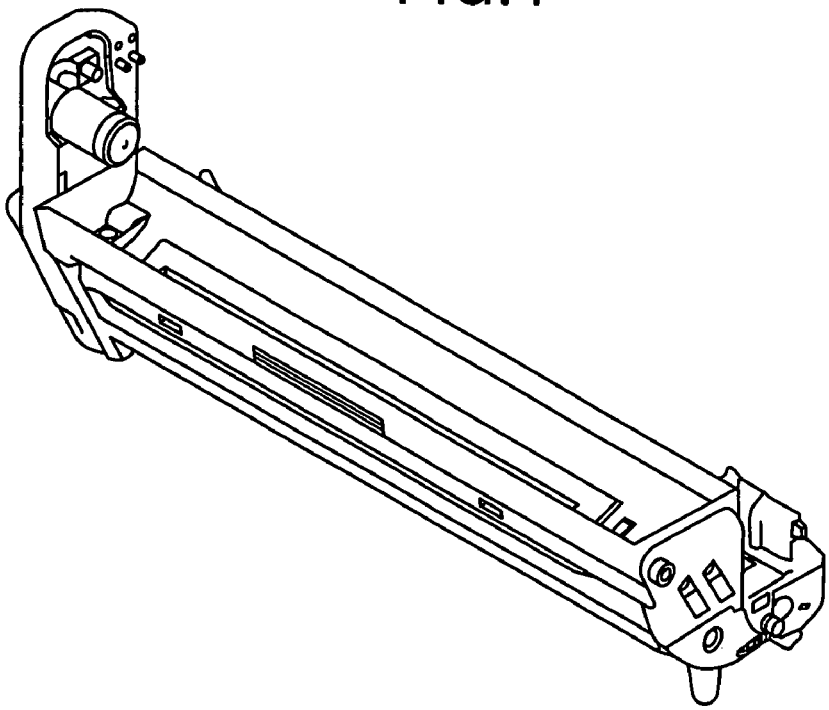
FIG. 4 is another perspective view of the image forming section when the developer cartridge has been detached.

FIG. 2 is an expanded view of an image forming section from which a toner cartridge has been detached. FIG. 3 is a perspective view of the image forming section when the toner cartridge has been detached. FIG. 4 is another perspective view of the image forming section when the toner cartridge has been detached.

Referring to FIG. 1, an image forming apparatus 10 includes an image forming sections 20K (black), 20Y (yellow), 20M (magenta), and 20C (cyan), and a fixing unit 30, which are aligned along a transport path from upstream to downstream with respect to the direction of travel of the paper 21 and form toner images of corresponding colors on the paper 21. The image forming apparatus 20 may take the form of, for example, a printer, a facsimile machine, or a copying machine in which electrophotography is employed to form monochrome images or color images on a print medium including print paper, an envelope, and a transparency (OHP sheet). The fixing unit 30 fixes the toner images of the respective colors into a full-color permanent image. Alternatively, the image forming apparatus 10 may be an image forming apparatus capable of printing only monochrome images.

The image forming apparatus 10 further includes transfer rollers 24*k*, 24Y, 24M, and 24C, transport rollers 23*a*-23*x*, drive rollers 25*a* and 25*b*, movable guides 26*a* and 26*b*, belt-cleaning blade 27, a waste toner tank 28, and a paper cassette 29. The paper cassette 29 holds a stack of paper 21.

The image forming apparatus 10 further includes an operational panel, a communication interface, a drive mechanism including motors and gears, and a control section (not shown) that control overall operation of the image forming apparatus 10. The drive mechanism drives various rollers and movable components in rotation.

The image forming section 20K, 20Y, 20M, and 20C each include a photoconductive drum 11, a charging roller 12, an LED printhead 13, a developing roller 14, a toner supplying roller 15, and a developing blade 17. The charging roller 12 charges the surface of the photoconductive drum 11. The LED printhead 13 illuminates the charged surface of the photoconductive drum 11 to form an electrostatic latent image. The developing roller 14 supplies the toner to the photoconductive drum 11 to develop the electrostatic latent image with the toner into a toner image. The toner supplying roller 15 supplies the toner to the developing roller 14. The developing roller 14 and the toner supplying roller 15 are driven by the aforementioned drive mechanism to rotate in directions shown by arrows B and C, respectively. The developer used is a non-magnetic one-component toner.

The image forming apparatus 10 includes transfer rollers 24 and a cleaning blade 18. The transfer rollers 24 parallel the photoconductive drums 11, and sequentially transfer toner images of corresponding colors onto the paper 21 that is transported on a transfer belt 22. The cleaning blade 18 scrapes the residual toner off the photoconductive drum 11. The cleaning blade 18 is supported by a supporting member (not shown) such that the cleaning blade is in pressure contact with the photoconductive drum 11 under a line pressure of 1.6 gf/mm.

The photoconductive drum 11 includes an electrically conductive support covered with a photoconductive layer. The electrically conductive support takes the form of a pipe of aluminum. The photoconductive layer includes a charge generating layer and a charge transporting layer, which are laminated one over the other. The charging roller 12 includes a metal shaft covered with a layer of semi-conductive epichlorohydrin rubber. The developing roller 14 includes a metal shaft covered with a layer of semi-conductive urethane rubber. The toner supplying roller 15 includes a metal shaft covered with a layer of semi-conductive foamed silicone sponge.

The toner T includes polyester resin as a binder resin, internal additives, and an external additive. The internal additives include a charge control agent, a toner release agent, and a colorant. The external additive is, for example, silica particles. The developing blade 17 is formed of stainless. The cleaning blade 18 is formed of urethane.

The construction of the toner cartridge will be described.

Figure 5:
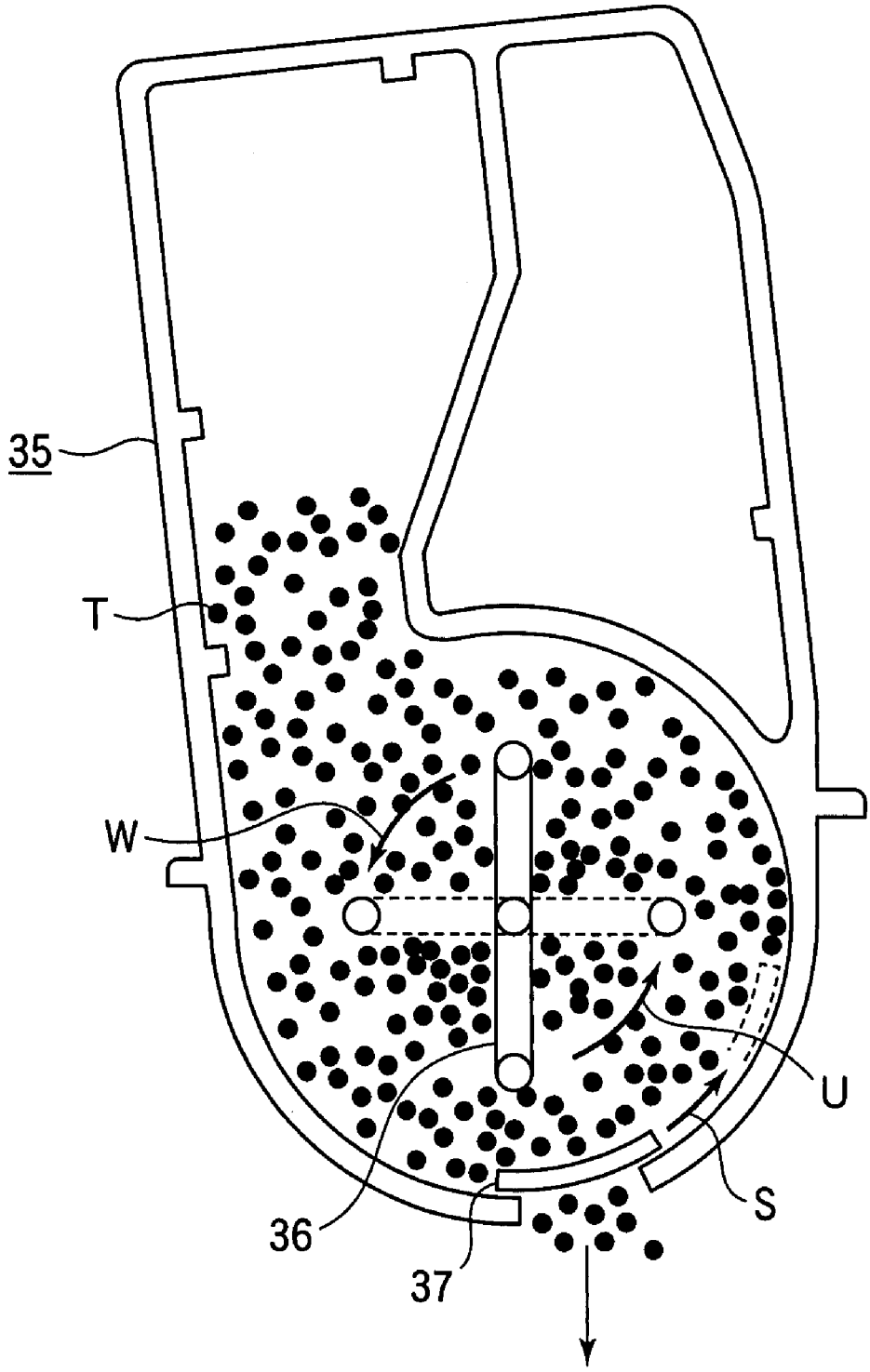
FIG. 5 is a cross-sectional view illustrating a general configuration of a toner cartridge of the first embodiment.
Figure 6:
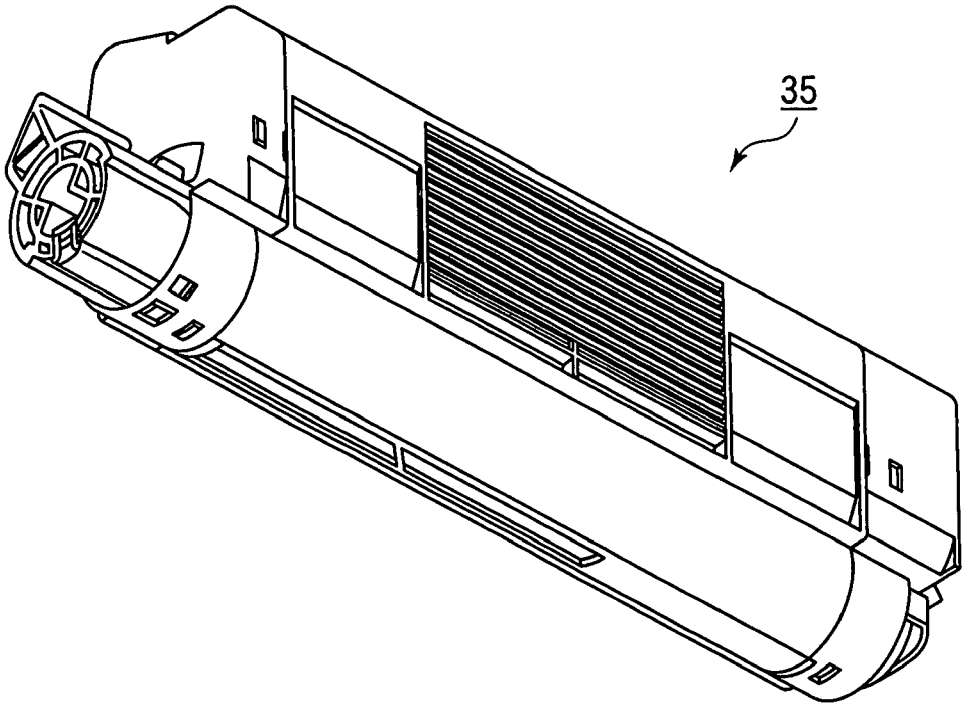
FIG. 6 is a first perspective view of the toner cartridge.
Figure 7:
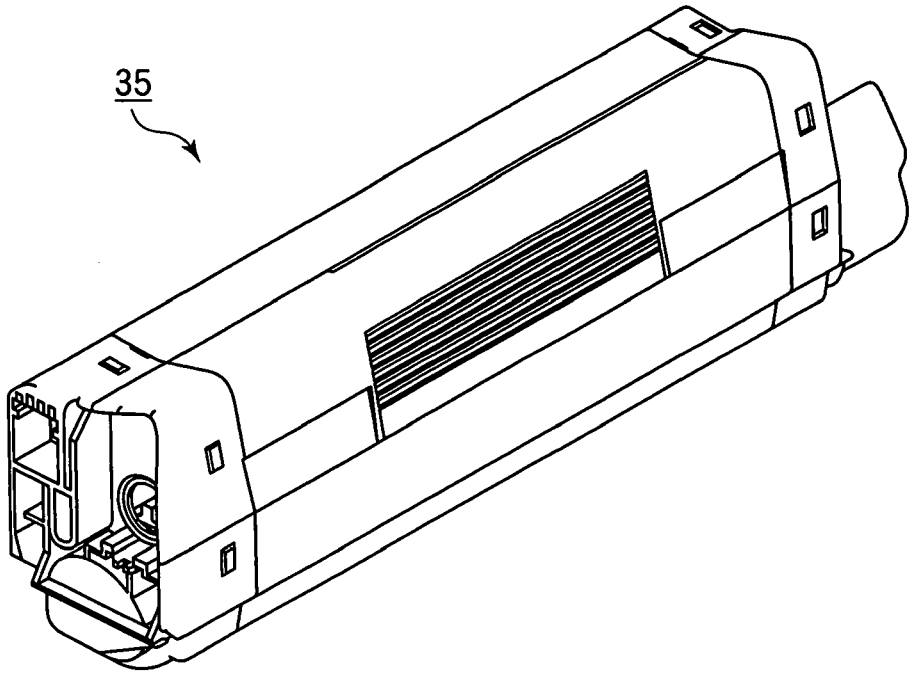
FIG. 7 is a second perspective view of the toner cartridge.
Figure 8:
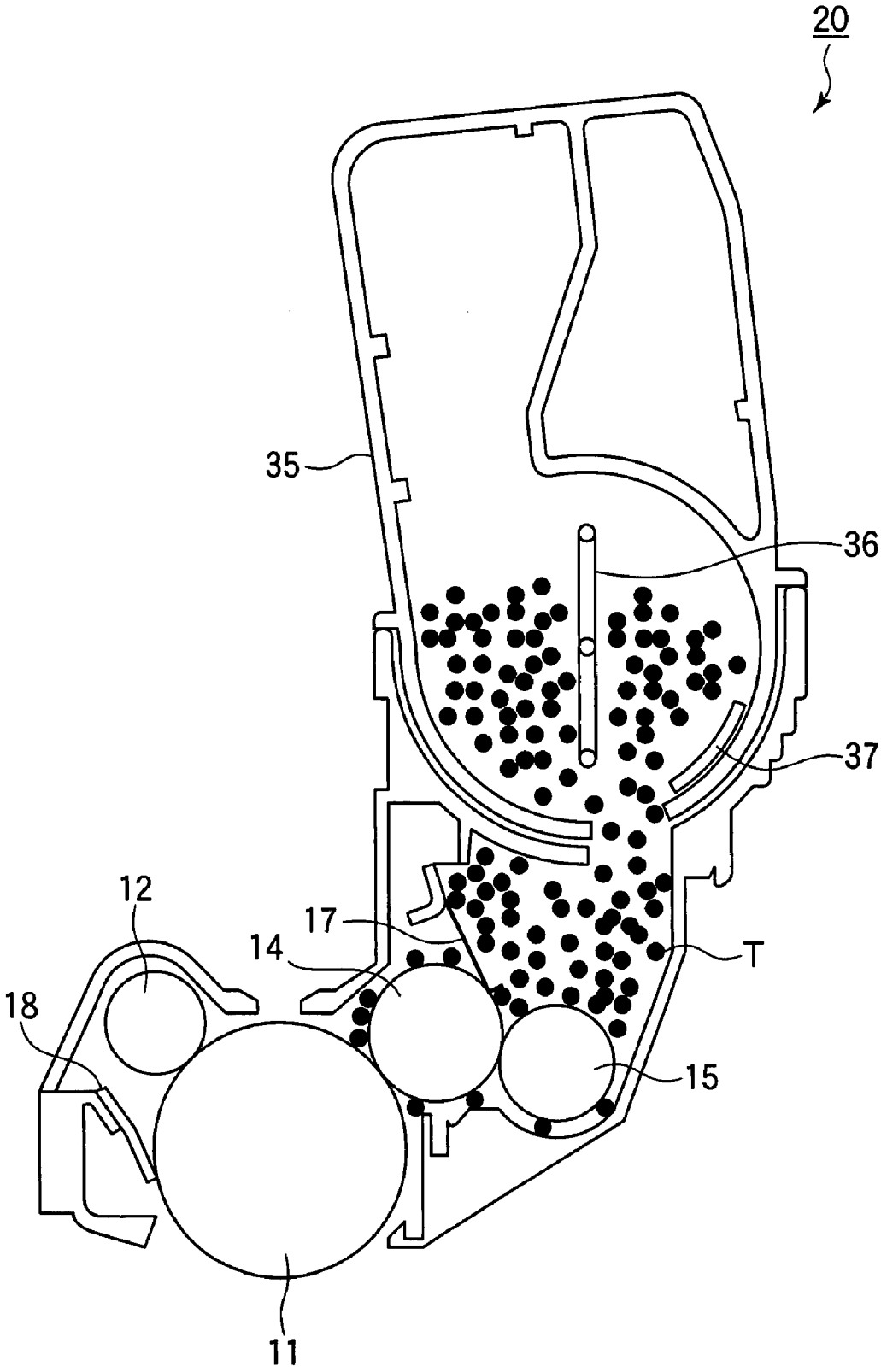
FIG. 8 illustrates an image forming section to which a toner cartridge of a corresponding color has been attached.
Figure 9:
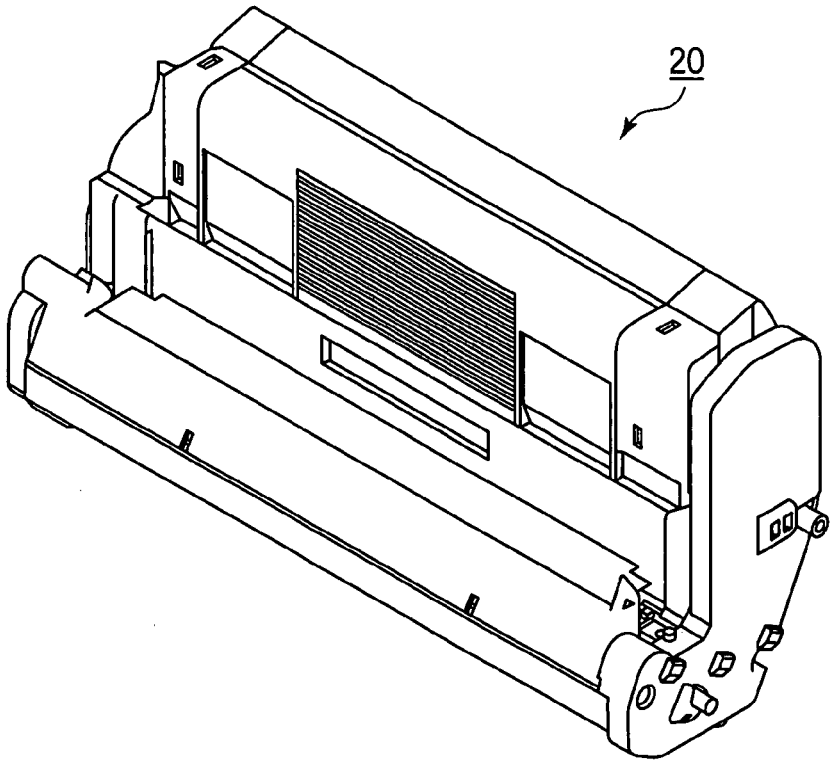
FIG. 9 is a first perspective view of the image forming section to which the toner cartridge has been attached.
Figure 10:
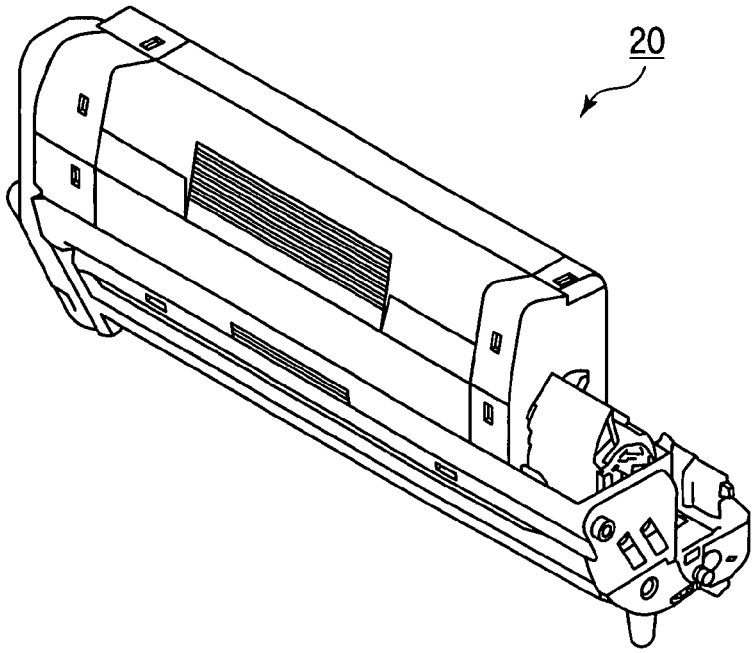
FIG. 10 is a second perspective view of the image forming section to which the toner cartridge has been attached.

FIG. 5 is a cross-sectional view illustrating a general configuration of a toner cartridge of a first embodiment. FIG. 6 is a first perspective view of the toner cartridge. FIG. 7 is a second perspective view of the toner cartridge. FIG. 8 illustrates an image forming section to which a toner cartridge of a corresponding color has been attached. FIG. 9 is a first perspective view of the image forming section to which the toner cartridge has been attached. FIG. 10 is a second perspective view of the image forming section to which the toner cartridge has been attached.

Referring to FIG. 5, a toner cartridge 35 holds toner T therein and includes an opening formed in its bottom wall. The toner T is supplied through the opening onto a toner supplying roller 15. The toner cartridge 35 also includes an agitator bar 36 that rotates to agitate the toner T, and shutter 37 that opens and closes the opening.

Figure 11:
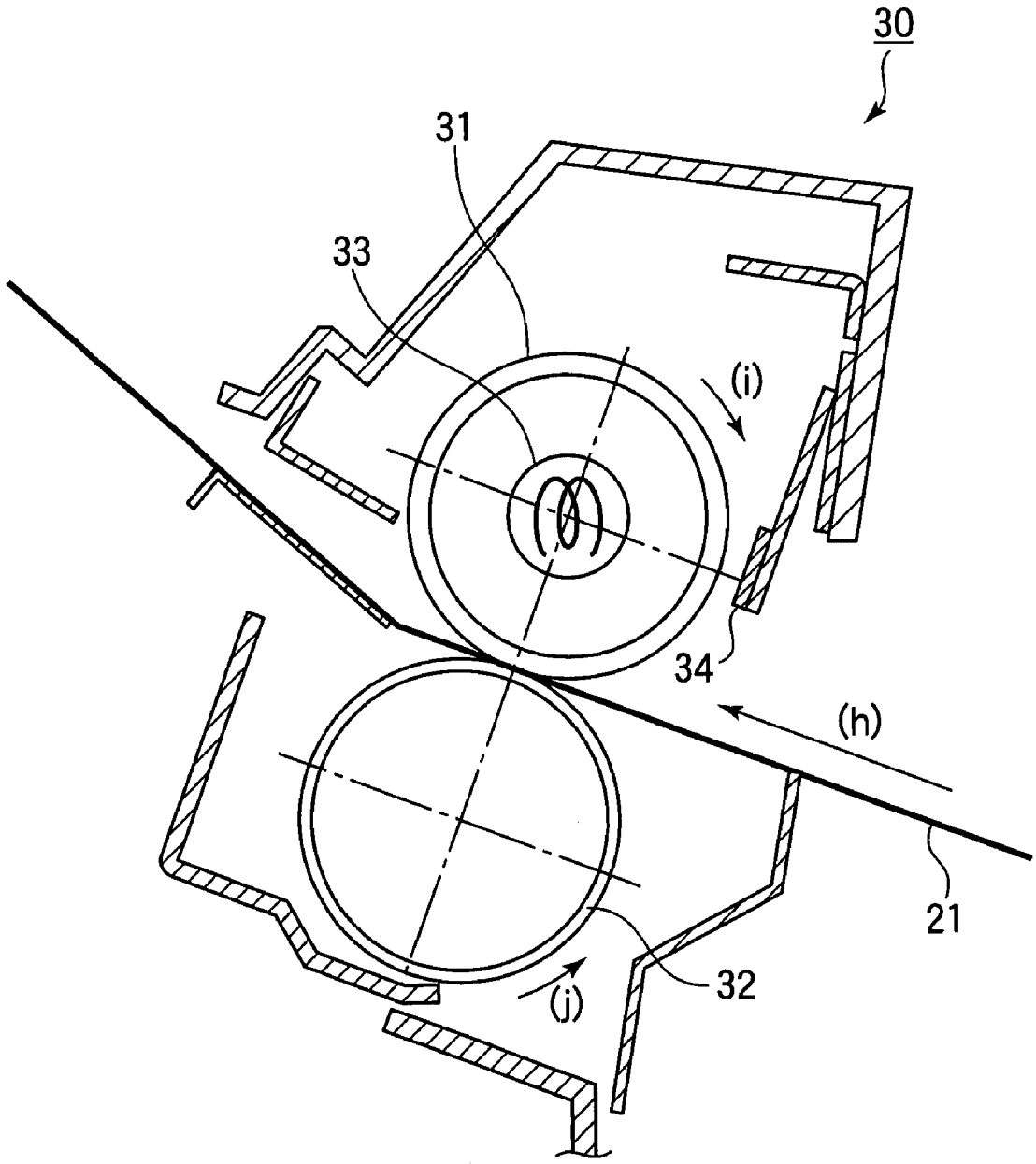
FIG. 11 is an expanded view of a fixing unit.

FIG. 11 is an expanded view of the fixing unit 30. The configuration of the fixing unit 30 will be described with reference to FIG. 11. Referring to FIG. 11, the fixing unit 30 includes a heat roller 31 and a pressure roller 32. The heat roller 31 and the pressure roller 32 are in pressure contact with each other to define a fixing point therebetween. When the paper 21 passes through a fixing point defined between the heat roller 31 and the pressure roller 32, the toner image on the paper 21 is fused into a permanent image under heat and pressure.

The heat roller 31 includes a hollow core metal of aluminum covered with a heat resistant resilient layer of silicone rubber. The heat resistant layer is covered with a toner releasing layer in the shape of a tube formed of a copolymer of polytetrafluoro-ethylene and perfluoro alkyl vinyl ether (PFA). The pressure roller 32 includes a hollow aluminum cylinder covered with a heat resistant resilient rubber layer.

The heat roller 31 includes a heater 33 in the form of, for example, a halogen lamp. A thermistor 34 is disposed in the vicinity of the heat roller 31 to detect the surface temperature of the heat roller 31. The thermistor 34 is not in contact with the heat roller 31.

The fixing unit 30 of the first embodiment is an oilless type fixing unit which employs rollers. The fixing unit 30 may be one of other types including a belt type, a film type, and a flash type providing that the fixing unit is of the oilless type. For example, a roller type fixing unit or a belt type fixing unit employ oilless fixing, thereby preventing "hot offset."

The fixing unit 30 does not require an oil supplying device which is a consumable item. The image forming apparatus 10 may be miniaturized and implemented at low cost correspondingly.

The operation of the image forming apparatus 10 will be described as follows:

Referring to FIG. 2, the photoconductive drum 11 is driven by a driving means (not shown) to rotate at a constant circumferential speed in a direction shown by arrow A. The charging roller 12 rotates in contact with the photoconductive drum 11 in a direction shown by arrow D. A high DC voltage is applied to the charging roller 12, which in turn uniformly charges the circumferential surface of the photoconductive drum 11.

The LED print head 13 illuminates the charged surface of the photoconductive drum 11 to dissipate the charges, thereby forming an electrostatic latent on the surface of the photoconductive drum 11.

Referring to FIG. 5, the agitator bar 36 rotates in directions shown by arrows W and U. When the shutter 37 is moved in a direction shown by arrow S to open the opening, the toner falls in a direction shown by arrow V onto the toner supplying roller 15.

A high-voltage source (not shown) applies a high voltage to the toner supplying roller 15. The toner supplying roller 15 rotates in the C direction (FIG. 2) to supply the toner T to the developing roller 14. The developing roller 14 rotates in contact with the photoconductive drum 11. Another high-voltage source (not shown) applies a high voltage to the developing roller 14. Therefore, the developing roller 14 attracts the toner T supplied from the toner supplying roller 15, and transports the toner in a direction shown by arrow B. The developing blade 17 is in contact with the developing roller 14 forms a thin layer of toner on the developing roller 14.

The developing roller 14 develops the electrostatic latent image with the toner into a toner image as follows: Another high-voltage source applies a bias voltage across the conductive support of the photoconductive drum 11 and the developing roller 14, thereby creating an electric field across the electrostatic latent image and the developing roller 14. The charged toner T on the developing roller 14 is attracted to the electrostatic latent image by the electric field, thereby developing the electrostatic latent image into a toner image.

The paper 21 is fed out of the paper cassette 29 on a page-by-page basis, and is advanced by the transport rollers 23*a* and 23*b*. The paper 21 is further transported by the transport rollers 23*c*, 23*d*, 23*e*, and 23*f* in a direction shown by arrow E. The paper 21 further advances toward the transfer belt 22 while being guided by a guide member (not shown). The transfer belt 22 is driven to run in a direction shown by arrow F when the drive rollers 25*a* and 25*b* are rotated.

The transfer belt 22 is sandwiched between the transfer roller 24K and the photoconductive drum 11. The transfer roller transfers the toner image from the photoconductive drum 11 onto the paper 21. A high voltage source applies a high voltage to the transfer roller. The paper 21 is advanced by the transfer belt 22 in the F direction through image forming sections 20K, 20Y, 20C for yellow, magenta, and cyan, respectively, in sequence. The transfer rollers 24Y, 24M, and 24C transfer the yellow, magenta, and cyan toner images onto the paper 21, respectively onto the paper 21. Then, the paper 21 is further transported in a direction shown by arrow H.

Referring to FIG. 11, the paper 21 is advanced in the H direction to the fixing unit 30. A temperature controller (not shown) controls supply of electric power to the halogen lamp of the heater 33 based on the surface temperature of the heat roller 31 detected by the thermistor 34, thereby maintaining the surface temperature of the heat roller 31 at a predetermined temperature.

The paper 21 having the toner image thereon passes through the fixing point defined between the heat roller 31 and the pressure roller 32, the toner image on the paper 21 being fused into a permanent image under heat and pressure.

The paper 21 having the permanent image is then transported by the transport rollers 23*g*-23*j* in a direction shown by arrow K onto a stacker outside of the image forming apparatus 10.

Referring back to FIG. 2, the cleaning blade 18 extends in a longitudinal direction in parallel to the photoconductive drum 11. One widthwise end of the cleaning blade 18 is supported by a fixed supporting means and the other opposite widthwise end is in contact with the surface of the photoconductive drum 11. Some toner T is left on the surface of the photoconductive drum 11 after transfer. The residual toner is scraped off by the cleaning blade 18 such that the surface of the photoconductive drum 11 is ready for the next image forming cycle.

When pages of paper 21 are transported successively, some insufficiently charged toner particles may be transferred from the photoconductive drum 11 onto the transfer belt 22. When the transfer belt 22 runs in a direction shown by arrow R, the cleaning blade 27 scrapes the residual toner T off the transfer belt 22 into the waste toner tank 28. Thus, the transfer belt 22 is ready for the next image forming cycle.

Non-magnetic one-component toner of the first embodiment is manufactured by a well known pulverization method. In the pulverization method, a toner release agent having a lower softening point than a toner resin tends to appear on the surface of base toner particles. Besides, the toner resin is manufactured such that the resin is easy to be fused during fixing. Because the surface of the base toner particles is relatively soft, an external additive is easy to adhere to the base toner particles.

Toners manufactured in the suspension polymerization and the emulsion polymerization methods are of a multilayer structure where the base toner has a core resin and a shell resin. A toner release agent having a lower softening point than a toner resin is difficult to appear on the surface of the base toner particles. Besides, the core resin has a higher softening point than the shell resin. Thus, the surface of the base toner is relatively hard so that an external additive is difficult to adhere to the surface of the base toner, and may be liberated from the surface. The additive that has liberated from the surface tends to coalesce to form larger particles. This implies that a large amount of external additive is necessary in order to obtain the surface-coating effect of the external additive similar to the pulverization method. Therefore, the suspension polymerization and the emulsion polymerization methods are not suitable for the present embodiment.

In the present embodiment, the average roundness of the toner particles produced by the pulverization method is preferably in the range of 0.91 to 0.94, depending on the conditions of pulverization.

Roundness is given by Equation (1) as follows:

$$\text{Roundness}=2\pi r/L \quad (1)$$

where $2\pi r$ is the circumference of a circle having an area equal to the projected area of the bi-level image of a toner particle when the toner particle is projected onto a two-dimensional plane, and L is the perimeter or circumference of the toner particle.

Roundness is a measure of how close to a perfect sphere a toner particle is. If a toner particle is a perfect sphere, the roundness of the toner particle is 1.00. The more a toner particle deviates from a sphere, the smaller the roundness is. An average value of roundness may be obtained by dividing the sum of values of roundness of toner particles (e.g., 3500 particles) by the number of particles (e.g., 3500 particles).

Particles having an average value of roundness of less than 0.91 are difficult to move around during development of a toner electrostatic latent image and transfer of a toner image, impairing normal image quality. In order to achieve an average roundness greater than 0.94, the toner particles should be subjected to heat treatment after pulverization. However, heater treatment causes non-uniform dispersion of the toner release agent that would otherwise remain uniformly dispersed in the base toner particles. As a result of heat treatment, the toner release agent appears on the surface of toner particles causing the toner particles to coalesce or reducing the flow-ability of the toner particles. Thus, average values of roundness greater than 0.94 are not desirable.

Experiments performed using a variety of types of toners will be described. FIG. 12 is a first table that lists types of toners tested and the test results. FIG. 13 is a second table that lists another test results. FIG. 14 is a table that lists the number of rotations of the photoconductive drum 11 and the developing roller 14.

Example 1

TONER 1 was manufactured as follows: The following materials were mixed in a HENSCHEL MIXER: 100 weight parts polyester resin (number average molecular weight Mn=3700, glass transition temperature Tg=62° C.) as a binder resin; 1.0 weight parts salicylic acid complex (BONTRON e-84, available from ORIENT CHEMICAL INDUSTRIES LTD) as a charge control agent; 4.0 weight parts pigment blue 15:3 [ECB-301] (available from DAINICHISEIKA CHEMICALS MFG. CO., LTD) as a coloring agent or colorant; and 5.0 weight parts carnauba wax (powder of carnauba wax #1, melting point=87° C., available from S. KATO & Co.) as a toner release agent. Then, the mixture was melted, kneaded in a dual extruder, and cooled. The cooled material was then crushed with a cutter mill having a screen of a 2 mm-diameter, and is subsequently pulverized with a dispersion separator (NIHON PNEUMATIC INDUSTRIES LTD). Finally, the pulverized material is classified using a pneumatic separator, thereby obtaining a powder or base toner (i.e., toner before an external additive is added to it).

Hydrophobic silica R972 (average diameter of primary particles=16 nm, Japan Aerosil) in an amount of 2.0 weight parts and hydrophobic silica NAX-50 (average diameter of primary particles=30 nm, Japan Aerosil) in an amount of 1.0 weight parts were added to the base toner in an amount of 100 weight parts. This mixture was agitated for 5 minutes at 3200 rpm in a HENSCHEL MIXER of 10 liters capacity, thereby obtaining TONER 1.

The diameter of primary particles of the external additive was measured as follows: The particles of the external additive were photographed using a scanning electron microscope (SEM) at an acceleration voltage of 10 kV and with a magnification of 20000 to 50000 times. Fifty of photographed particles were randomly picked up and an average value of the diameters of the primary particles was defined as a diameter of the primary particles.

The volume mean particle diameter of TONER 1 was measured with a Coulter's counter (Coulter Multisizer 3, available from BECKMAN COULTER) at an aperture of 100 μm. The measurement was repeated 30,000 times, and the volume mean particle diameter was found to be 6.1 μm.

Printing was performed using TONER 1 and the image forming apparatus in FIG. 1, and printing results shown in FIGS. 12 and 13 were obtained.

The printing speed (i.e., circumferential speed of the photoconductive drum 11) was 200 mm/s. Continuous printing was performed on 30,000 pages of A4 size standard paper (grammage=80 g/m$^2$) in portrait orientation at a printing duty of 0.3%. Printing duty is the ratio of a total printed area on the paper 21 to a total printable area on the same paper 21. When solid printing is performed in the total printable area, printing duty is 100%. Thus, a printing duty of 0.3% indicates that a printed area represents 0.3% of the total printable area. FIG. 14 shows the number of printed pages, the number of rotations of the photoconductive drum 11, and the number of rotations of the developing roller 14. The diameters of the photoconductive drum 11 and developing roller 14 are 30 mm and 15.95 mm, respectively.

Printing was also performed on A4 size standard calendered paper at a printing duty of 1% for first pages in continuous printing and for pages after the continuous printing. Likewise, calendered paper was advanced through the fixing unit 30 without the respective image forming sections 20K, 20Y, 20M, and 20C attached to the image forming apparatus. The resulting difference (color difference, ΔE) between the hue (L*a*b*) of non-printed areas of the printed paper (print duty of 1%) and the hue (L*a*b*) of the calendered paper that passed only through the fixing unit 30, was measured with spectrophotometer CM-2600d (MINOLTA, C light source, observer: 2 degrees). This difference was measured as a level of fog of calendered paper. The larger the value of ΔE is, the poorer the print quality is.

The value of fog of calendered paper was ΔE=1.2 for first pages in continuous printing and ΔE=1.5 for pages after the continuous printing. The ΔE not larger than 1.5 is determined to be satisfactory, i.e., the level of fog for monochrome color is good, and it is therefore believed to be that the level of fog for full color should also be good.

The gloss of A4 standard calendered paper used in the continuous printing was measured with a MURAKAMI COLOR RESEARCH LABORATORY GLOSS METER (Type GM-26D, angle of incidence and angle of reflection are 75 degrees). The gloss was 58.7% on the front surface and 48.9% on the back surface. The A4 size standard calendered paper had a grammage of 120 g/m$^2$, and was 110 kg.

Thereafter, solid printing was performed on standard paper, and no defect was observed in the printed image. After continuous printing, the developing roller 14 was dismounted from the image forming section. Without directly contacting the toner, the residual toner electrostatically attracted to the surface of the developing roller 14 was removed by using a toner-cleaning machine or by spraying nitrogen gas. No fused toner was observed on the surface of the developing roller 14, and the rubber surface of the developing roller 14 was clearly observed.

Example 2

TONER 2 was manufactured under the same conditions as EXAMPLE 1 except that the amount of hydrophobic silica NAX-50 was 3.0 weight parts.

Continuous printing similar to that for EXAMPLE 1 was performed using TONER 2. The value of fog of calendered paper was ΔE=1.1 for first pages in the continuous printing and ΔE=1.2 after the continuous printing. This is considered that an increased amount of hydrophobic silica NAX-50 serves as a spacer against the pressure exerted on the toner by various components of the image forming section, alleviating the stress on the toner particles hence decreasing fog. The difference in the value of fog of calendered paper between the first pages in the continuous printing and the pages after the continuous printing was very small. Subsequent solid printing was satisfactory in that no significant defect was observed in images and no fused toner was observed on the surface of the developing roller 14.

Example 3

TONER 3 was manufactured under the same conditions as EXAMPLE 1 except that 1.0 weight parts Silica X-24-9163A (SHINETSU KAGAKU KOGYO, mean particle diameter: 110 nm) was used in place of hydrophobic silica NAX-50.

Continuous printing similar to that for EXAMPLE 1 was performed using TONER 3. The value of fog of calendered paper was ΔE=1.2 for first pages in the continuous printing and ΔE=1.4 for pages after the continuous printing. Because hydrophobic silica NAX-50 is large in diameter and small in the number of particles, this external additive does not effectively serve as a spacer as opposed to EXAMPLE 1. Thus, the value of fog ΔE was somewhat large. Subsequent solid printing was satisfactory in that no significant defect was observed in printed images and no fused toner was deposited on the surface of the developing roller 14.

Example 4

TONER 4 was manufactured under the same conditions as EXAMPLE 3 except that the amount of Silica X-24-9163A was 3.0 weight parts.

Continuous printing similar to that of EXAMPLE 1 was performed using TONER 4. The value of fog of calendered paper was ΔE=1.0 for first pages in the continuous printing and ΔE=1.1 for pages after the continuous printing. It is believed to be that because hydrophobic silica NAX-50 was large in amount as compared to the EXAMPLE 3 and effectively served as a spacer, the value of fog ΔE was generally small. Thus, fog after the continuous printing was little. Subsequent solid printing was satisfactory in that no significant defect in printed images was observed and no fused toner was observed on the surface of the developing roller 14.

Example 5 to Example 8

The conditions in pulverization and classification of the method of manufacturing the toner described in EXAMPLE 1 were altered to manufacture a base toner having a small size (volume mean diameter=3.9 μm). The external additives used for TONER 1 to TONER 4 were added to this base toner to produce TONER 5 to TONER 8.

Continuous printing similar to that for EXAMPLE 1 was performed using TONER 5 to TONER 8 to evaluate the values of fog of calendered paper, defects in solid images, and the surface of the developing roller 14. The test results are listed in FIGS. 12 and 13.

The effect of the particle diameter and the amount of additive on the value of fog of calendered paper for TONER 5 to TONER 8 was almost the same as for TONER 1 to TONER 4. However, the value of fog of calendered paper was smaller in TONER 5 to TONER 8 that have a volume mean diameter of 3.9 μm than in TONER 1 to TONER 4 that have a volume mean diameter of 6.1 μm. In other words, the fog of calendered paper was good in TONER 5 to TONER 8. Calendered paper has a smoother surface than standard paper. Therefore, the toner adhering on the paper due to fog may be easily fused during the fixing process, and therefore fused toner particles on the paper look large and are noticeable. From this fact, it is believed to be that toner having a smaller mean particle diameter is advantageous in preventing fog of calendered paper. Subsequent solid printing using TONER 5 to TONER 8 resulted in no significant defect in printed images and no fused toner on the surface of the developing roller 14.

Comparative examples will be described.

Comparative Example 1

The conditions in pulverization and classification of the method of manufacturing toner described in EXAMPLE 1 were altered to manufacture a base toner having a large size (volume mean diameter=8.0 μm). The external additives used for TONER 1 were added to this base toner to produce TONER 9. Continuous printing similar to that of EXAMPLE 1 was performed using TONER 9 to evaluate the value of fog of calendered paper, defects in solid images, and the surface of the developing roller 14.

Visual observation was made for initial fog of calendered paper. The toner had adhered to a non-image area on the calendered paper and print quality was poor. The value of fog was ΔE=1.6. The non-printed image portion was observed under a magnifier, and flattened toner particles were observed. For relatively large toner particles, the value of fog ΔE appeared to be noticeable. The print quality was poor in that the value of fog ΔE after the continuous printing was ΔE=1.8 and therefore the fog was noticeable on the calendered paper. No abnormality of solid images was observed after the continuous printing. The surface of the developing roller 14 was very clean in that no fused toner was observed.

Comparative Example 2

The conditions in pulverization and classification of the method of manufacturing toner described in EXAMPLE 1 were altered to manufacture a base toner having a small size (volume mean diameter=3.0 μm). Hydrophobic silica R972 (average diameter of primary particles=16 nm, Japan Aerosil) in an amount of 2.0 weight parts and hydrophobic silica X-24-9163A by 3.0 weights (average diameter of primary particles=110 nm, Japan Aerosil) were added to this base toner to produce TONER 10. Continuous printing similar to that of EXAMPLE 1 was performed using TONER 10 to evaluate the value of fog of calendered paper, defects in solid images, and the surface of the developing roller 14.

The value of fog was ΔE=0.8, which is good. In subsequent continuous printing, background soiling occurred in which toner adheres to a non-image area occurred after printing 25,000 pages. Thus, the printing was discontinued, and the surface of the developing roller 14 was observed. A thin layer of fused toner was observed on the surface of the developing roller 14, i.e., the developing roller 14 was coated with the fused toner. This is believed to have been caused by the fact that the coating of toner on the developing roller behaves as an electrical resistance causing the layer of non-fused toner on the toner coating on the developing roller 14 to be charged more, and that the overcharging of the toner caused background soiling. Because of poor image quality, the continuous printing was aborted before printing on 30,000 pages has been completed.

It is considered that toner particles having smaller diameters have larger surface areas in contact with the developing roller 14 and therefore are subjected to increased friction. The increased friction tends to cause the toner to fuse and then adhere to the surface of the developing roller 14.

Comparative Example 3

Hydrophobic silica R972 (average diameter of primary particles=16 nm, Japan Aerosil) in an amount of 2.0 weight parts and hydrophobic silica RX200 (average diameter of primary particles=12 nm, Japan Aerosil) in an amount of 3.0 weight parts were added to the base toner of EXAMPLE 5 in an amount of 100 weight parts. The base toner has a mean particle diameter of 3.9 μm. Thus, TONER 11 was obtained. Continuous printing similar to that of EXAMPLE 1 was performed using TONER 10 to evaluate the value of fog of calendered paper, defects in solid images, and the surface of the developing roller 14.

Visual observation was made for initial fog of calendered paper. The value of fog ΔE was ΔE=1.4, which is good. However, the value of fog ΔE after continuous printing was ΔE=2.1, which is very poor. It is considered that silica as an external additive having a relatively small particle diameter tends to sink in the base toner particles during continuous printing, causing non-uniform charging of toner particles and the poorly charged toner particles adhered to the paper surface.

No abnormality of solid images was observed after the continuous printing. The surface of the developing roller 14 was very clean in that no fused toner was observed on the developing roller 14.

Comparative Example 4

Hydrophobic silica R972 (average diameter of primary particles=16 nm, Japan Aerosil) in an amount of 2.0 weight parts and hydrophobic silica TSX-55 (average diameter of primary particles=300 nm, SHINETSU KAGAKU) in an amount of 3.0 weight parts were added to the base toner of EXAMPLE 1 (mean particle diameter of 6.1 μm) in an amount of 100 weight parts. Thus, TONER 12 was obtained. Continuous printing similar to that of EXAMPLE 1 was performed using TONER 12 to evaluate the value of fog of calendered paper, defects in solid images, and the surface of the developing roller 14.

The initial value of fog of calendered paper was ΔE=1.2, which is good. In the subsequent continuous printing, background soiling occurred after printing 15,000 pages, i.e., toner adhered to a non-image area. Thus, the printing was discontinued, and the surface of the developing roller 14 was observed. A thin LAYER OF fused toner was observed on the surface of the developing roller 14, i.e., the developing roller 14 was coated with the melted toner. This is believed to have been caused by the fact that the coating of toner on the developing roller 14 behaves as an electrical resistance causing the layer of non-fused toner on the coating to be charged more, and that the overcharging of the toner caused background soiling. Because of poor image quality, the continuous printing was aborted before printing on 30,000 pages has been completed.

It is considered that the external additive tends to come off the surface of toner particles because of the large particle diameter of external additive and the surface of the base toner particles is subjected to friction between the developing roller 14. The increased friction tends to cause the toner to fuse and then adhere to the surface of the developing roller 14.

Comparative Example 5

Hydrophobic silica R972 (average diameter of primary particles=16 nm, Japan Aerosil) in an amount of 2.0 weight parts and hydrophobic silica NAX-50 (average diameter of primary particles=30 nm, Japan Aerosil) in an amount of 0.50 weight parts were added to the base toner of EXAMPLE 5 in an amount of 100 weight parts. The base toner has a mean particle diameter of 3.9 μm. Thus, TONER 13 was obtained. Continuous printing similar to that of EXAMPLE 1 was performed using TONER 13 to evaluate the value of fog of calendered paper, defects in solid images, and the surface of the developing roller 14.

The initial value of fog of calendered paper was ΔE=0.9, which is good. In the subsequent continuous printing, background soiling occurred after printing 20,000 pages, i.e., toner adhered to a non-image area. Thus, the printing was discontinued, and the surface of the developing roller 14 was observed. A thin layer of fused toner was observed on the surface of the developing roller 14, i.e., the developing roller was coated with the fused toner. This is believed to have been caused by the fact that the coating of toner on the developing roller 14 behaves as an electrical resistance causing the layer of non-fused toner deposited on the coating on the developing roller 14 to be charged more, and that the overcharging of the toner caused background soiling. Because of poor image quality, the continuous printing was aborted before printing on 30,000 pages has been completed.

The external additives have not large particle diameters and therefore the surface of the based toner is subjected to the friction between the developing roller 14 and the base toner. It is considered that the base toner tends to fuse and then adhere to the surface of the developing roller 14.

Comparative Example 6

Hydrophobic silica R972 (average diameter of primary particles=16 nm, Japan Aerosil) in an amount of 2.0 weight parts and hydrophobic silica X-24-9163A in an amount of 5.0 weight parts were added to the base toner of EXAMPLE 1 in an amount of 100 weight parts. The base toner has a mean particle diameter of 6.1 μm. Thus, TONER 14 was obtained. Continuous printing similar to that of EXAMPLE 1 was performed using TONER 14 to evaluate the value of fog of calendered paper, defects in solid images, and the surface of the developing roller 14.

The initial value of fog of calendered paper was ΔE=0.8, which is good. After continuous printing, the value of fog of calendered paper was ΔE=2.0, which is very poor. No abnormality was observed in a solid image after the continuous printing. No fused toner was observed on the surface of the developing roller 14 but external additives liberated from the toner particles were deposited on the developing roller 14. It is believed to be that because a large amount of external additive was used, the external additive was easy to be liberated from the toner particles and was deposited on the surface of the developing roller 14 to cause poor charging of the toner, hence poor fog.

For EXAMPLE 1 (TONER 1) to EXAMPLE 8 (TONER 8), COMPARATIVE EXAMPLE 1 (TONER 9), COMPARATIVE EXAMPLE 3 (TONER 11), and COMPARATIVE EXAMPLE 6 (TONER 14), continuous printing was performed on additional 10,000 pages after the continuous printing on 30,000 pages. Very good printed images were obtained for TONERs 1, 6, 9, and 14. For TONERs 2 to 11, vertical streaks (in the direction parallel to the direction of travel of the paper) was observed and no toner was present on surface areas of the developing roller 14 that correspond to the streaks.

The developing blade 17 was detached from the developing roller and observation was made of a portion that had been in contact with the developing roller 14. Filming caused by fused toner was observed on the surface of the developing blade 17. For TONERs 2 and 11, the cake of toner was wiped off the developing blade 17 by using alcohol-soaked absorbent cotton and SEM observation was made. Under SEM observation, a large amount of the external additives was on the developing blade 17. For TONERs 3, 4, 5, 7, and 8, little or no external additive was observed.

Filming on the developing blade 17 did not occur throughout the continuous printing on 30,000 pages. Filming on the developing roller 14 for continuous printing on 40,000 pages was the same as those shown in FIG. 12.

FIG. 13 illustrates the filming on the developing blade and percentages of coating of external additives having mean particle diameters in the range of 30-110 nm on the base toner particles. The data shown in FIG. 13 reveal that percentages of coating of external additives on the base toner particles in the range of 30.6 to 58.6% cause no filming on the developing blade 17. Percentages of coating less than 30.6% cause the toner to fuse and then to adhere to the developing blade 17. Percentages of coating greater than 58.6% cause the external additives to adhere to the developing blade 17 and then fuse on the developing blade 17.

The percentage of coating of external additives may be obtained by the following equation.

$$C = \frac{\sqrt{3}}{2\pi} \times \frac{D \times P \times w}{d \times \rho} \times 100 \quad (2)$$

where C is a percentage of coating (%), D is a toner resin density (g/cm$^3$), w is the amount of an external additive by weight parts, d is diameter of the external additive (μm), and ρ is the density of the external additive (g/cm$^3$).

As described above, in the present embodiment, the volume mean particle diameter of toner is in the range of 3.9 to 6.1 μm. An external additive has a mean particle diameter in the range of 30 to 110 nm. The external additive in an amount of 1.0 to 3.0 weight parts was added to the base toner in an amount of 100 weight parts. Thus, for continuous printing on 30,000 pages of calendered paper, no filming occurs on the developing roller and no fog due to oppositely charged toner occurs.

For an external additive having a mean particle diameter in the range of 30-110 nm, the percentage of coating in the range of 30.6-58.6% prevents filming on the developing blade 17 for continuous printing on 40,000 pages. The smaller the particle diameter of the external additive is, the larger the flow-ability is obtained. However, particles of external additive having small particle diameters tend to sink down in the base toner particles. External additives having particle diameters in the range of 30 to 110 nm retain appropriate flow-ability and are difficult to sink down in the base toner particles.

Toner particles having a volume mean particle diameter larger than 6.1 μm are easy to become flat causing fog on the calendered paper and deterioration in resolution. Toner particles having a volume mean particle diameter smaller than 3.9 μm are difficult to come off the base toner particles due to Van der Waals forces, impairing developing and transferring performance.

An external additive having a mean particle diameter larger than 110 nm is easy to come off the base toner particles. An external additive having a mean particle diameter smaller than 30 nm is easy to sink down in the base toner particles. In any case, these external additives do not perform as a spacer among toner particles nor do they perform as a flow-ability adding agent.

The amount of external additive larger than 3.0 weight parts will adhere to the various components of the image forming sections 20K, 20Y, 20M, and 20C (e.g., the developing blade 17 and rollers including the developing roller 14), and causes fusion and adhesion of the toner, hence filming. The external additives do not fuse in the fixing unit 30, being easy to cause "offset in fixing." The amount of an external additive smaller than 1.0 weight parts fails to ensure flow-ability of toner, and therefore causes vague images due to an insufficient amount of toner supply.

When the percentage of coating is out of the range of 30.6-58.6%, the effects of the percentage of coating on filming depends on the amount of the external additive. If the particles of external additive are not uniformly mixed with the base toner particles due to agglomeration of base toner, then the external additive does not properly act as a flow-ability improving agent, in which case the percentage of coating should be more precisely controlled.

Second Embodiment

Elements similar to those of the first embodiment have been given the same reference numerals, and their description is omitted.

Figure 16:
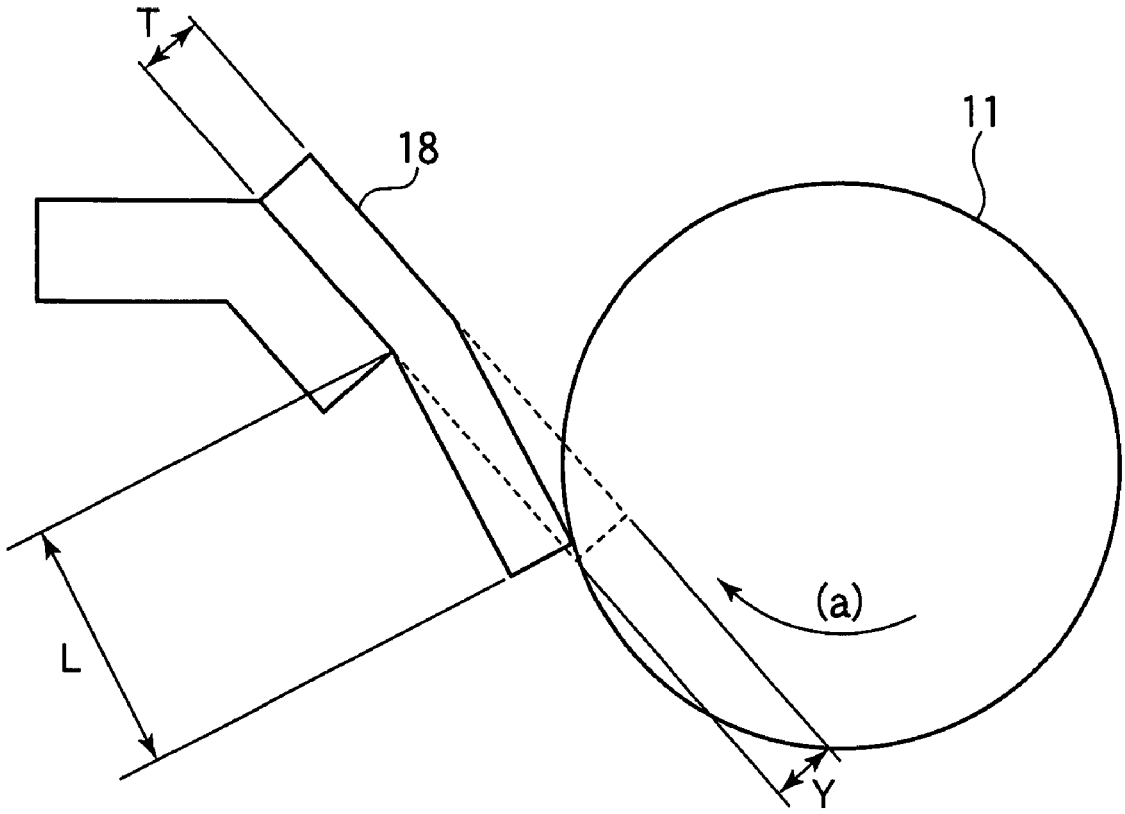
FIG. 16 illustrates how a cleaning blade is set in pressure contact with the photoconductive drum.

FIG. 15 is a table that lists the number of printed pages, the number of rotations of a photoconductive drum 11, and the number of rotations of a developing roller 14. FIG. 16 illustrates how the cleaning blade 18 is set in pressure contact with the photoconductive drum 11. FIG. 17 is a table that lists the results of the experiments.

The configuration and operation of the image forming apparatus are the same as those in the first embodiment. Therefore, a description will be given only of the results of the experiments.

Example 9

Using TONER 5, intermittent printing was performed on a page-by-page basis at a printing duty of 0.3% on 20,000 pages of paper. The cleaning blade 18 was set in pressure contact with the photoconductive drum 11 under a line pressure of 1.4 gf/mm. The printing speed was 200 mm/sec. The print medium was A4 size standard paper (grammage=80 g/m$^2$) was advanced in portrait orientation.

Intermittent printing on a page-by-page basis is a printing operation in which the image forming section is halted every time printing has completed on a page and is then started again to operate for the next page.

Solid printing was performed on one page after the intermittent printing on 20,000 pages of paper. Visual inspection was made of a printed image or the surface of the photoconductive drum 11 for filming. The image forming section is brought into operation and subsequently out of operation repeatedly during the intermittent printing. Repeating to bringing the image forming section into operation and then into halt alternately is apt to cause filming on the photoconductive drum 11. Therefore, filming on the photoconductive drum 11 was evaluated by performing intermittent printing.

The line pressure of the cleaning blade exerted on the photoconductive drum 11 was set by adjusting the material of the cleaning blade 18 and deflection of the cleaning blade in pressure contact with the photoconductive drum 11.

The line pressure may be determined by the following equation.

$$W = \frac{E \times T^3 \times Y}{4L^3} \quad \text{Eq. (3)}$$

W: line pressure of the cleaning blade exerted on the photoconductive drum (gf/mm)

E: Young's Modulus of the cleaning blade (gf/mm$^2$)

T: Thickness of the cleaning blade (mm)

L: Deflection of the cleaning blade (mm)

L: Length of the free end portion of the cleaning blade (mm)

FIG. 16 illustrates the relationship among T, Y, and L.

Specifically, the cleaning blade 18 is formed of urethane #201708 (Young's Modulus=67 kg/cm$^2$, available from HOKUSHIN KOGYO), and has a thickness T=1.6 mm and a free end portion of L=7 mm. The cleaning blade 18 was set in pressure contact with the photoconductive drum 11 such that the deflection Y was Y=0.7 mm. The line pressure was W=1.4 gf/mm.

FIG. 17 is a table that lists test results when intermittent solid printing was performed on 20,000 pages.

Visual inspection was made on the surface of the photoconductive drum 11. Narrow, thin streaks were found on the surface of the photoconductive drum 11. Infrared spectroscopic analysis and SEM observation showed that a small amount of toner was fused on the photoconductive drum 11. No defect was observed on a printed image and no effect of filming on the photoconductive drum was observed on the printed image. Thus, filming on the photoconductive drum was ranked as "GOOD" in FIG. 17.

Example 10 to Example 12

Using TONER 1, TONER 6, and TONER 7, intermittent printing was performed in the same manner as in EXAMPLE 9.

No effect of filming on the photoconductive drum 11 was observed on a printed image. No fusion and adhesion of the toner were observed by visual inspection on the photoconductive drum 11. Thus, filming on the photoconductive drum 11 was ranked as "EXCELLENT."

Comparing the results of EXAMPLE 9 with those of EXAMPLE 10 to EXAMPLE 12 reveals that TONER 5 may be most apt to cause filming on the photoconductive drum 11. This is believed to be that the smaller the particle diameters of toner, the smaller particle diameters of external additive, and the smaller the amount of external additive, the more the filming on the photoconductive drum is apt to occur.

Example 13

Intermittent printing was performed using TONER 5 under the same conditions as in EXAMPLE 9 except that the deflection of the cleaning blade 18 was Y=0.4 mm and the line pressure was 0.8 gf/mm.

Visual inspection was made of the surface of the photoconductive drum 11. Narrow, thin streaks were observed on the surface of the photoconductive drum 11. In other words, a small amount of toner has been fused and deposited on the photoconductive drum 11. No defect was observed on a printed image and no effect of filming on the photoconductive drum 11 was observed on the printed image. Thus, filming on the photoconductive drum was ranked as "GOOD" in FIG. 17.

Example 14

Intermittent printing was performed using TONER 5 under the same conditions as in EXAMPLE 9 except that the deflection of the cleaning blade 18 was Y=0.8 mm and the line pressure was 1.6 gf/mm.

No effect of filming on the photoconductive drum 11 was observed on a printed image. Visual inspection found neither fusion nor adhesion of the toner on the photoconductive drum 11. Thus, filming on the photoconductive drum was ranked as "EXCELLENT."

Example 15

Intermittent printing was performed using TONER 5 under the same conditions as in EXAMPLE 9 except that the deflection of the cleaning blade 18 was Y=1.2 mm and the line pressure was 2.4 gf/mm.

No effect of filming on the photoconductive drum 11 was observed on a printed image. Visual inspection found neither fusion nor adhesion of the toner on the photoconductive drum 11. Thus, filming on the photoconductive drum was ranked as "EXCELLENT."

COMPARATIVE EXAMPLE 7 and COMPARATIVE EXAMPLE 8 will now be described.

Comparative Example 7

Intermittent printing was performed using TONER 5 under the same conditions as in EXAMPLE 9 except that the deflection of the cleaning blade 18 was Y=0.2 mm and the line pressure was 0.4 gf/mm.

Less than ten streaks were observed on a printed image after intermittent printing of 5,000 pages. Streaks were observed substantially on the entire surface of the paper after intermittent printing of 10000 pages, and therefore the test was aborted. The image forming section was investigated. Poor cleaning had occurred where the cleaning blade 18 fails to completely scrape the toner off the photoconductive drum 11. The residual toner was found to have adhered to the charging roller 12. It is believed to be that the residual toner adhering to the charging roller caused poor charging of the photoconductive drum 11 and therefore caused an image more like a solid image which would otherwise be 0.3%, i.e., the toner was deposited substantially on the entire surface of the photoconductive drum. Poor cleaning appeared to have occurred because a line pressure of 0.4 gf/mm was too low.

Comparative Example 8

Intermittent printing was performed using TONER 5 under the same conditions as in EXAMPLE 9 except that the deflection of the cleaning blade 18 was Y=1.5 mm and the line pressure was 3.0 gf/mm.

Numerous streak-like patterns having lengths of 1 to 3 mm were observed on both the photoconductive drum and the printed images. Infrared spectroscopic analysis and SEM observation showed that these patterns were caused by the toner fused and deposited on the photoconductive drum 11. Areas on the paper in which no toner has been deposited corresponded to the streak-like patterns formed on the photoconductive drum 11. Since numerous streaks were found on the printed images, filming was ranked as "POOR." It is believed to be that the high line pressure exerted a large friction force on the toner to cause the toner to fuse on the photoconductive drum 11.

As described above, in the present embodiment, the line pressure of the cleaning blade 18 is set in the range of 0.8-2.4 gf/mm. The line pressure in this range prevents filming on the developing roller while also preventing the effects of the filming occurred on the photoconductive drum 11 on the printed images. The line pressure is more preferably in the range of 1.6-2.4 gf/mm for more efficiently preventing filming on the photoconductive drum 11.

The binder resin for the toner may be selected from among polyester resins, styrene acrylic resins, epoxy resins, or stylene-butadiene resins.

The toner release agent used in the present invention includes alphatic hydrocarbon wax such as low molecular weight polyethylene, olefin copolymers, micro crystalline wax, paraffin wax, carnauba wax, or montanic acid ester wax, i.e., a wax whose main composition is fatty ester. The amount of toner release agent should be in the range of 0.1-15 weight parts, and more preferably in the range of 0.5-12 weight parts, based on 100 weight parts binder resin. Alternatively, more than one wax may be used.

The colorants used in the toner of the invention may be selected from among dyes and pigments used for conventional black toner or color toners. The colorants include carbon black, phtalocyanine blue, permanent brown FG, brilliant first scarlet, pigment green B, rhodamine-B-base, solvent red 49, solvent red 146, pigment blue 15:3, solvent blue 35, quinacridone, and carmine 6B. The amount of colorant is preferably in the range of 2-25 weight parts based on 11000 weight parts the binder resin.

The toner of the invention may contain additives such as a charge control agent, a conductivity control agent, a loading pigment, a reinforcing fibrous filler, an antioxidant, and a fluidity (flow ability) improving agent.

The toner of the invention may contain an inorganic powder for improving the stability against environmental changes, the ability to develop, the flow-ability, and the storage stability. The inorganic powder is preferably added to the surface of the toner particles, and is preferably hydrophobic. The inorganic powder may take the form of silica fine powder or a hydrophobized material of silica fine powder.

The photoconductive drum of the invention may be an inorganic photoconductive drum in which a photoconductive layer such as selenium is formed on an electrically conductive roller of aluminum. Alternatively, the photoconductive drum may take the form of an electrically conductive roller covered with an organic photoconductive layer in which a charge generating agent and a charge transporting agent are dispersed.

The cleaning blade of the invention may be formed of a resilient material including urethane rubber, epoxy rubber, acrylic elastomer, fluoroplastic rubber, stylene-butadiene rubber (SBR), and polybutadiene rubber.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer material comprising:

pulverized base particles having a mean volume particle diameter in the range of 3.9-6.1 μm; and an external additive including particles having a mean particle diameter in the range of 30-110 nm, said external additive being present in an amount in the range of 1.0-3.0 weight parts based on 100 weight parts of the base particles, the external additive covering a partial surface area of the base particles in the range of 30.6-58.6% of a total surface area of the base particles.

2. The developer material according to claim 1, wherein the developer material is a non-magnetic one-component developer.

3. A developer material cartridge that holds a developer material therein, the developer material comprising:

pulverized base particles having a mean volume particle diameter in the range of 3.9-6.1 μm; and an external additive including particles having a mean particle diameter in the range of 30-110 nm, said external additive being present in an amount in the range of 1.0-3.0 weight parts based on 100 weight parts of the base particles, the external additive covering a partial surface area of the base particles in the range of 30.6-58.6% of a total surface area of the base particles.

4. The developer material according to claim 3, wherein the developer material is a non-magnetic one-component developer.

5. An image forming device, comprising:

a developer material including pulverized base particles containing at least a binder resin and a colorant therein and having a mean volume particle diameter in the range of 3.9-6.1 μm, and an external additive including particles having a mean particle diameter in the range of 30-110 nm, said external additive being present in an amount in the range of 1.0-3.0 weight parts based on 100 weight parts of the base particles, the external additive covering a surface of the base particles;

a latent image bearing body;

a charging member that charges a surface of said latent image bearing body;

a developer material bearing body that supplies the developer material to a latent image formed on said the latent image bearing body to form a visible image;

a resilient member in contact with said latent image bearing body, said resilient member being disposed upstream of said charging member and downstream of said developer material bearing body, the resilient member applying a line pressure in the range of 0.8-2.4 gf/mm on said latent image bearing body.

6. The image forming device according to claim 5, wherein the developer material is a non-magnetic one-component developer.

7. The image forming device according to claim 5, wherein external additive covers a surface of the base particles, a surface area of the base particles being covered with said external additive, the surface area being in the range of 30.6-58.6% of a total surface area of the base particles.

8. An image forming apparatus, comprising:

a developer material including pulverized base particles containing at least a binder resin and a colorant therein and having a mean volume particle diameter in the range of 3.9-6.1 μm, and an external additive including particles having a mean particle diameter in the range of 30-110 nm, said external additive being present in an amount in the range of 1.0-3.0 weight parts based on 100 weight parts of the base particles, the external additive covering a surface of the base particles;

a latent image bearing body;

a charging member that charges a surface of said latent image bearing body;

a developer material bearing body that supplies the developer material to a latent image formed on said the latent image bearing body to develop the latent image into a visible image; and a resilient member in contact with said latent image bearing body, said resilient member being disposed upstream of said charging member and downstream of said developer material bearing body and transferring the visible image on a print medium, the resilient member applying a line pressure in the range of 0.8-2.4 gf/mm on said latent image bearing body.

9. The developer material according to claim 8, wherein the developer material is a non-magnetic one-component developer.

10. The image forming section according to claim 8, wherein the external additive covers a surface of the base particles, a surface area of the base particles covered with said external additive being in the range of 30.6-58.6% of a total surface area of the base particles.

11. The developer material according to claim 1, wherein the developer material has a roundness in the range of 0.91 to 0.94.

12. The developer material cartridge according to claim 3 wherein the developer material has a roundness in the range of 0.91 to 0.94.

13. The developer material cartridge according to claim 5, wherein the developer material has a roundness in the range of 0.91 to 0.94.

14. The developer material cartridge according to claim 8, wherein the developer material has a roundness in the range of 0.91 to 0.94.

15. The developer material cartridge according to claim 5, wherein the resilient member is a cleaning member.

16. The developer material cartridge according to claim 15, wherein the cleaning member has one end fixed to a supporting member and another end abutting a latent image bearing body.

17. The developer material cartridge according to claim 8, wherein the resilient member is a cleaning member.

18. The developer material cartridge according to claim 17, wherein the cleaning member has one end fixed to a supporting member and another end abutting a latent image bearing body.

19. The developer material according to claim 1, wherein the base particles contain at least a binder resin and a colorant.

20. The developer material according to claim 3, wherein the base particles contain at least a binder resin and a colorant.

* * * * *